US006133786A

United States Patent [19]

Symons

[11] Patent Number: 6,133,786

[45] Date of Patent: Oct. 17, 2000

[54] LOW IMPEDANCE GRID-ANODE INTERACTION REGION FOR AN INDUCTIVE OUTPUT AMPLIFIER

[75] Inventor: Robert Spencer Symons, Los Altos, Calif.

[73] Assignee: Litton Systems, Inc., Woodland Hills, Calif.

[21] Appl. No.: 09/054,747

[22] Filed: Apr. 3, 1998

[51] Int. Cl.[7] ..... H01J 25/04

[52] U.S. Cl. ..... 330/44; 330/45; 315/5; 315/5.37; 313/293; 313/447

[58] Field of Search ..... 315/4.5, 5.37; 330/44, 45; 313/293, 447

[56] References Cited

U.S. PATENT DOCUMENTS

| | | | |
|---|---|---|---|
| 2,485,400 | 10/1949 | McArthur | 330/45 |
| 4,480,210 | 10/1984 | Preist et al. | 315/4 |
| 4,527,091 | 7/1985 | Preist | 315/5 |
| 4,611,149 | 9/1986 | Nelson | 315/3.39 |
| 5,572,092 | 11/1996 | Shrader | 315/5.37 |
| 5,581,153 | 12/1996 | Bridges | 315/5 |
| 5,606,221 | 2/1997 | Sobieradzki et al. | 315/5.37 X |
| 5,629,582 | 5/1997 | Dobbs | 313/456 |
| 5,691,667 | 11/1997 | Pickering et al. | 330/44 |
| 5,767,625 | 6/1998 | Shrader et al. | 315/5.37 |

FOREIGN PATENT DOCUMENTS 0 627 757 A2 12/1994 European Pat. Off. .

*Primary Examiner*—Benny T. Lee

*Attorney, Agent, or Firm*—O'Melveny & Myers LLP

[57] ABSTRACT

A linear beam amplification device includes an axially centered electron emitting cathode and an anode spaced therefrom. The cathode provides an electron beam in response to a relatively high voltage potential defined between the cathode and the anode. A control grid is spaced between the cathode and anode for modulating the electron beam in accordance with an input signal. A signal input assembly of the linear beam amplification device comprises an axial input cavity into which the input signal is inductively coupled. The grid-cathode region is electrically connected to the input cavity. A low impedance grid-anode cavity is disposed coaxially with the input cavity and is in electrical communication with an interaction region defined between the grid and the anode. The low impedance of the grid-anode cavity is provided by constructing the cavity of a material having a relatively high surface resistivity, such as iron. The high surface resistivity tends to reduce the Q (quality factor) of the grid-anode cavity, which also reduces the impedance of the grid-anode cavity. Alternatively, the grid-anode cavity may be tuned to define a transmission line having an electrical length approximately equal to $n\lambda/4$, where $\lambda$ is the wavelength of the input RF signal, and n is an even integer.

36 Claims, 5 Drawing Sheets

LOW IMPEDANCE GRID-ANODE INTERACTION REGION FOR AN INDUCTIVE OUTPUT AMPLIFIER

BACKGROUND OF THE INVENTION

1. Field of the Invention

The present invention relates to inductive output amplifiers having RF modulation applied to an electron beam passing through a grid disposed between an electron emitting cathode and an anode. More particularly, the invention relates to a low impedance structure that prevents self-oscillation of the electron beam at a frequency determined in part by the resonant frequency of the grid-anode interaction region.

2. Description of Related Art

It is well known in the art to utilize a linear beam device, such as a klystron or travelling wave tube amplifier, to generate or amplify a high frequency RF signal. Such devices generally include an electron emitting cathode and an anode spaced therefrom. The anode includes a central aperture, and by applying a high voltage potential between the cathode and anode, electrons may be drawn from the cathode surface and directed into a high power beam that passes through the anode aperture.

One class of linear beam device, referred to as an inductive output amplifier, or inductive output tube (IOT), further includes a grid disposed in the inter-electrode region defined between the cathode and anode. The electron beam may thus be density modulated by applying an RF signal to the grid relative to the cathode. After the density modulated beam is accelerated by the anode, it propagates across a gap provided downstream within the inductive output amplifier and RF fields are thereby induced into a cavity coupled to the gap. The RF fields may then be extracted from the cavity in the form of a high power, modulated RF signal.

As the modulated electron beam passes through the interaction region defined between the grid and the anode, the modulated beam will radiate RF energy from the interaction region if a high enough impedance is presented to the modulated beam. Ideally, by avoiding reflections of the RF energy and surrounding the grid-anode interaction region with "free space," a low impedance is presented which minimizes RF radiation from the interaction region. In practice, however, there is some leakage of RF radiation from the grid-anode interaction region which can be harmful to other equipment and persons in proximity to the device, and can couple to the cathode-grid space causing oscillation. To prevent such undesirable leakage, the device is ordinarily enclosed within a metallic housing which effectively shields the RF radiation.

An unintended consequence of the housing, however, is that it necessarily forms a cavity connected to the grid-anode interaction region. If this grid-anode cavity presents a high impedance to the modulated electron beam, the beam will radiate RF energy into the grid-anode cavity which may be coupled back into the cathode-grid space. This can cause undesirable regeneration of the beam modulation, i.e., a self-oscillation condition in which the electron beam is further modulated at a frequency determined by the resonant frequencies of the cavities. The unwanted modulation of the electron beam interferes with the RF signal which is desired to be amplified by the inductive output amplifier, and the radiated RF energy reduces the power of the modulated beam, which reduces the gain of the amplifier. In extreme cases, the self-oscillation can generate voltages high enough to damage the amplifier.

An approach to overcoming this self-oscillation problem is to load the cavity with lossy material in order to present a low impedance to the electron beam over the band of frequencies at which the inductive output amplifier operates. As known in the art, ferrite loaded silicone rubber material presents a low impedance in the UHF and microwave frequency ranges and is capable of standing off very high DC voltages on the order of several tens of kilowatts. A drawback of the use of such lossy material is that it is labor intensive, and hence costly, to apply the material to the grid-anode interaction region. Moreover, the high voltage standoff characteristics of the material tend to degrade over time, which reduces the performance of the inductive output amplifier.

Thus, it would be desirable to provide an inductive output amplifier having a low impedance grid-anode interaction region which avoids self-oscillation. It would further be desirable to avoid the reliance upon lossy ferrite material in reducing the impedance of the interaction region.

SUMMARY OF THE INVENTION

In accordance with the teachings of the present invention, an inductive output amplifier is provided which has a low impedance grid-anode interaction region. The low impedance is achieved without requiring lossy ferrite material as in prior art systems, and serves to prevent RF radiation from the interaction region.

More particularly, a linear beam amplification device includes an axially centered electron emitting cathode and an anode spaced therefrom. The cathode provides an electron beam in response to a relatively high voltage potential defined between the cathode and the anode. A control grid is spaced between the cathode and anode for modulating the electron beam in accordance with an input signal. A signal input assembly of the linear beam amplification device comprises an axial input cavity into which the input signal is inductively coupled. The grid is electrically connected to the input cavity. An axially moveable tuning plunger is disposed within the input cavity with a inductive coupling loop coupled to the tuning plunger allowing cooperative movement therewith. A low impedance cavity is disposed coaxially with the input cavity and is in electrical communication with an interaction region defined between the grid and the anode. The grid-anode cavity and the input cavity are separated by a common conductive wall, such that the outer wall (or outer conductor of a coaxial transmission line) of the input cavity provides the inner wall (or center conductor) of the grid-anode cavity.

In a first embodiment of the signal input assembly, the grid-anode cavity is substantially enclosed by an outer wall in which both the common wall and the outer wall are comprised of a material having a relatively high RF surface resistivity, such as iron. The high RF surface resistivity tends to reduce the Q (quality factor) of the grid-anode cavity, reducing the impedance of the grid-anode cavity. The surface of the common wall within the input cavity may be plated with a coating having a relatively low RF surface resistivity, such as silver, so that the input cavity has a high Q. The low impedance grid-anode cavity would extract only minimal amounts of RF energy from the interaction region, resulting in negligible gain reduction of the inductive output amplifier.

In a second embodiment of the signal input assembly, the grid-anode cavity is provided with an adjustable tuning structure. The tuning structure permits the grid-anode cavity to be tuned to define a transmission line having an electrical length equivalent to $n\lambda/4$, where $\lambda$ is the wavelength of the input RF signal, and n is an even integer. The tuning structure comprises an axially movable choke disposed within the grid-anode cavity. The choke provides an RF short that conducts RF currents while maintaining a large DC voltage between the grid and the anode. As a result, the transmission line would have zero impedance at the interaction region, and would not extract any RF energy from the modulated beam.

A more complete understanding of the low impedance grid-anode interaction region for an inductive output amplifier will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for an inductive output amplifier having a low impedance interaction region between the grid and the anode. The low impedance is achieved without requiring lossy ferrite material as in prior art systems, and serves to prevent RF radiation from the modulated electron beam to the grid-anode interaction region. In the detailed description that follows, like element numerals are used to describe like elements shown in one or more of the figures.

Figure 1:
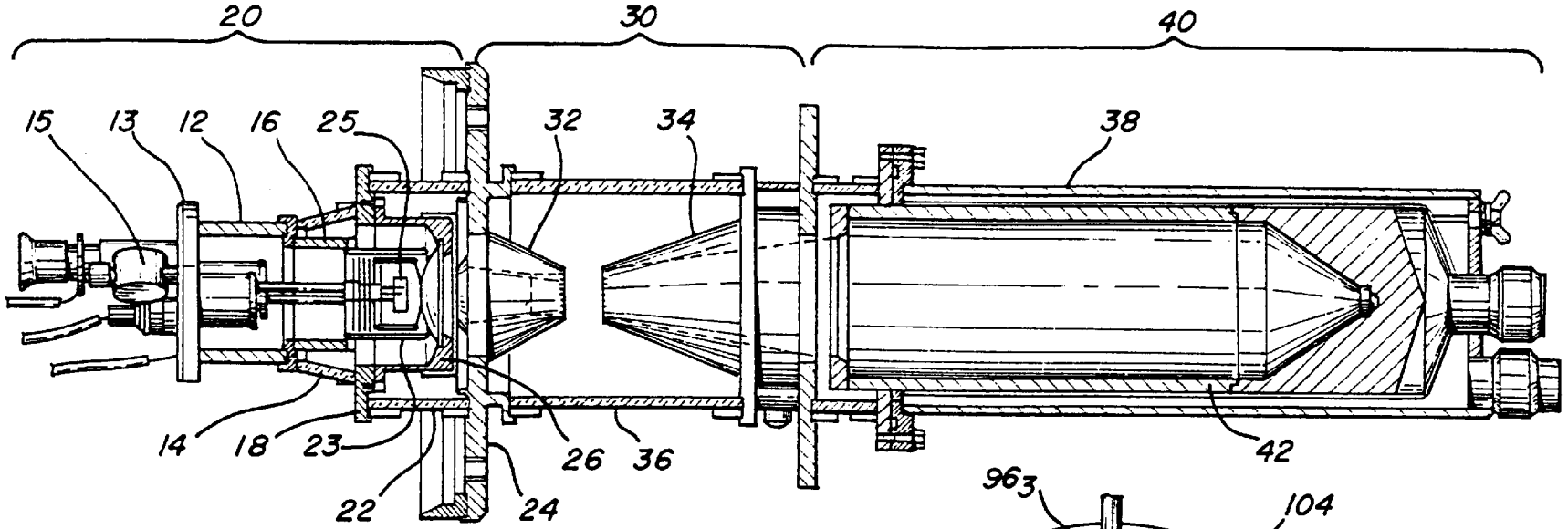
FIG. 1 is a cross-sectional side view of an inductive output amplifier in accordance with aspects of the present invention.

Referring first to FIG. 1, an inductive output amplifier is illustrated. The inductive output amplifier includes three major sections, including an electron gun 20, a drift tube 30, and a collector 40. The electron gun 20 provides an axially directed electron beam that is density modulated by an RF signal. The electron gun 20 and the circuit used to couple the RF signal to the electron gun is described in greater detail below.

Figure 4:
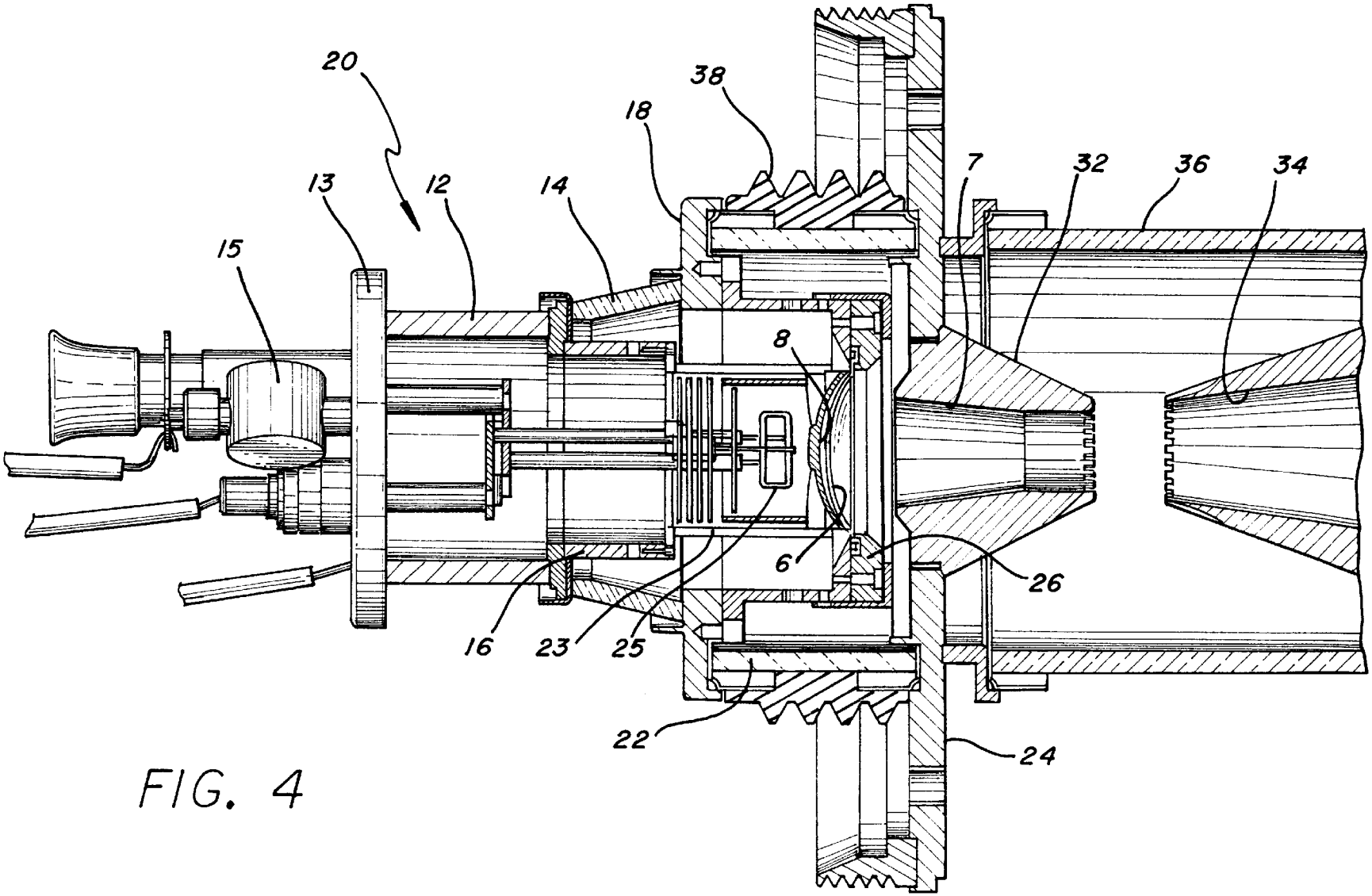
FIG. 4 is an enlarged cross-sectional side view of the inductive output amplifier illustrating the cathode, grid and anode assemblies.

The modulated electron beam passes through the drift tube 30, which further comprises a first drift tube portion 32 and a second drift tube portion 34 (see also FIG. 4). The first and second drift tube portions 32, 34 each have an axial beam tunnel extending therethrough, and are separated by a gap. An RF transparent shell 36 (see also FIG. 4), such as comprised of ceramic materials, encloses the drift tube portions and provides a partial vacuum seal for the device. An output cavity (not shown) may be coupled to the RF transparent shell 36 to permit RF electromagnetic energy to be extracted from the modulated beam as it traverses the gap.

The collector 40 comprises an inner structure 42 and an outer housing 38. The inner structure 42 has an axial opening to permit the spent electron beam to pass therethrough and be collected after having traversed the drift tube 30. The inner structure 42 may have a voltage applied thereto that is depressed below the voltage of the outer housing 38, and these two structures may be electrically insulated from one another. As illustrated in FIG. 1, the inner structure 42 provides a single collector electrode stage. Alternatively, the inner structure 42 may comprise a plurality of collector electrodes, each being depressed to a different collector voltage. An example of an inductive output amplifier having a multistage depressed collector is provided by U.S. Pat. No. 5,650,751, to R. S. Symons, the subject matter of which is incorporated in the entirety by reference herein. The collector 40 may further include a thermal control system for removing heat from the inner structure 42 dissipated by the impinging electrons.

The electron gun 20 is shown in FIG. 1, with in greater detail in FIG. 4, and includes a cathode 8 with a closely spaced control grid 6. The cathode 8 is disposed at the end of a cylindrical capsule 23 that includes an internal heater coil 25 coupled to a heater voltage source (described below). The cathode 8 is structurally supported by a housing that includes a cathode terminal plate 13, a first cylindrical shell 12 (see also FIG. 2), and a second cylindrical shell 16. The first and second cylindrical shells 12, 16 are comprised of electrically conductive materials, such as copper, and are axially connected together. The cathode terminal plate 13 permits electrical connection to the cathode 8, as will be further described below. An ion pump 15 is coupled to the cathode terminal plate 13, and is used to remove positive ions within the electron gun 20 that are generated during the process of thermionic emission of electrons, as known in the art.

The control grid 6 is positioned closely adjacent to the surface of the cathode 8, and is coupled to a bias voltage source (described below) to maintain a DC bias voltage relative to the cathode 8, and to an RF input signal to density modulate the electron beam emitted from the cathode. The grid 6 may be comprised of an electrically conductive, thermally rugged material, such as pyrolytic graphite. The grid 6 is physically held in place by a grid support 26. The grid support 26 couples the bias voltage and RF input signal to the grid 6 and maintains the grid in a proper position and spacing relative to the cathode 8. An example of a grid support structure for an inductive output amplifier is provided by copending patent application Ser. No. 09/017,369, filed Feb. 2, 1998, issued as U.S. Pat. No. 5,990,622 on Nov. 23, 1999, the subject matter of which is incorporated in the entirety by reference herein.

Figure 2:
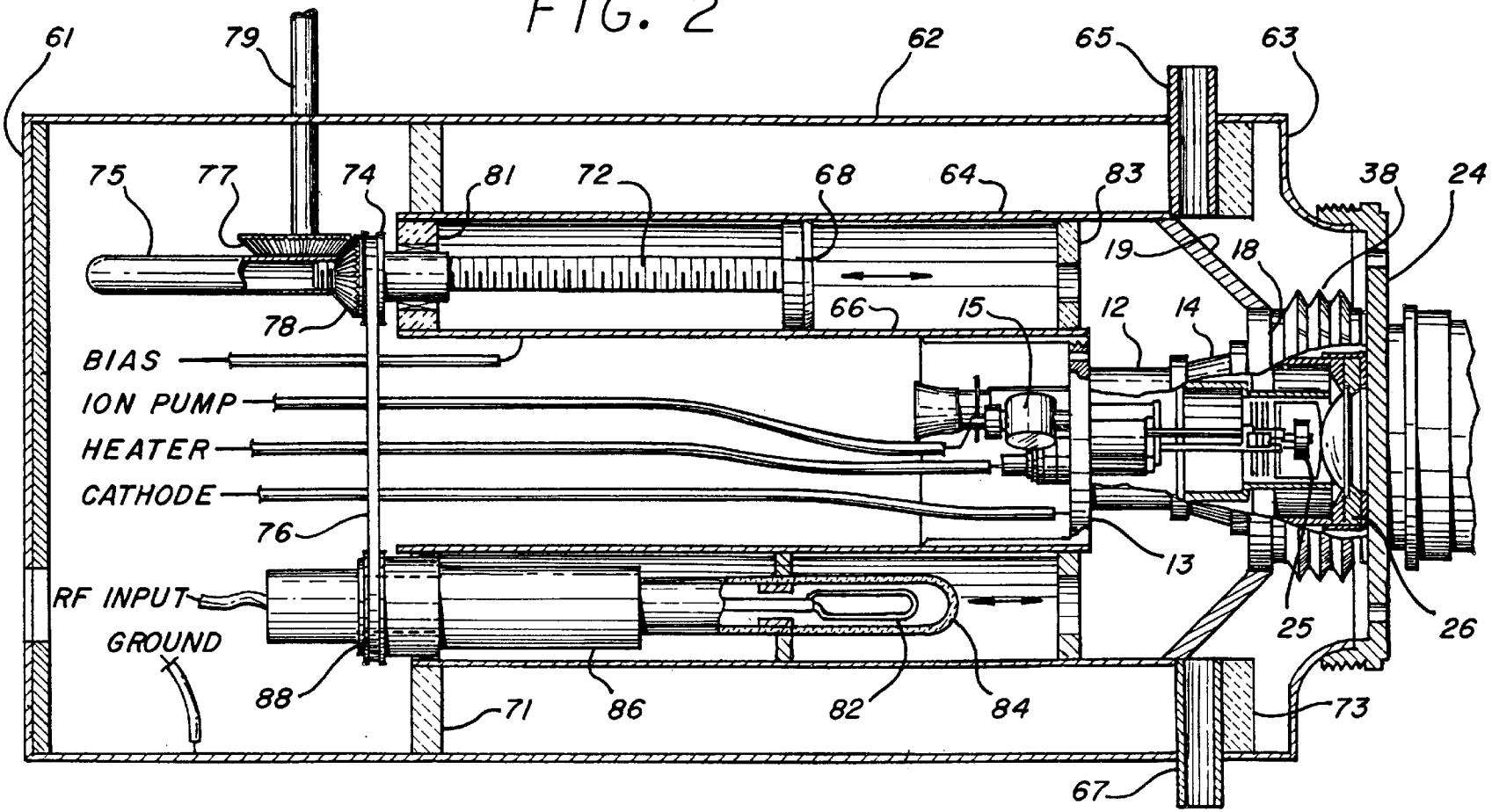
FIG. 2 is a cross-sectional side view of a first embodiment of a signal input assembly for the inductive output amplifier.

The grid support 26 is coupled to the cathode housing by a cathode-grid insulator 14 and a grid terminal plate 18 (see also FIG. 2). The insulator 14 is comprised of an electrically insulating, thermally conductive material, such as ceramic, and has a frusto-conical shape. The grid terminal plate 18 has an annular shape, and is coupled to an end of the cathode-grid insulator 14 so that the cathode capsule 23 extends therethrough. The grid terminal plate 18 permits electrical connection to the grid 6, as will be further described below. The grid support 26 includes a cylindrical extension that is axially coupled to the grid terminal plate 18. The diameter of the cylindrical extension of the grid support 26 is greater than a corresponding diameter of the cathode capsule 23 so as to provide a space between the grid 6 and cathode 8 and hold off the DC bias voltage defined therebetween.

The leading edge of the first drift tube portion 32 is spaced from the grid structure 26, and provides an anode 7 for the electron gun 20. The first drift tube portion 32 is held in an axial position relative to the cathode 8 and grid 6 by an anode terminal plate 24. The anode terminal plate 24 permits electrical connection to the anode 7, as will be further described below. The anode terminal plate 24 is coupled to the grid terminal plate 18 by an insulator 22 comprised of an RF transparent material, such as ceramic. The insulator 22 provides a portion of the vacuum envelope for the inductive output amplifier, and encloses the interaction region defined between the grid 6 and the anode 7 for which a low impedance structure is provided by this invention. The insulator 22 is covered by a seal 38 (see also FIG. 2) having a corrugated surface to increase the breakdown voltage path between the grid 6 and the anode 7. The seal 38 may be comprised of silicone rubber material that is substantially free of RF absorbing constituent elements.

Referring now to FIG. 2, a first embodiment of a signal input assembly for the inductive output amplifier is illustrated. The signal input assembly comprises three concentric cylinders. An outer cylinder 62 provides an external housing for the signal input assembly. An end plate 61 closes a first end of the outer cylinder 62. The opposite end of the outer cylinder 62 has a curved flange 63 that is coupled to the anode terminal plate 24 at an outer peripheral portion thereof. The outer cylinder 62 is coupled to ground through an insulated lead, labeled GROUND as is the anode through the anode terminal plate 24. Air inlet and exhaust ducts 65, 67 extend through the outer cylinder 62 to provide a flow of cooling air to the electron gun. As will be further described below, the outer cylinder 62 forms a portion of the grid-anode cavity.

An intermediate cylinder 64 is spaced within the outer cylinder 62 along a common axis with the outer cylinder. Annular shaped spacers 71, 73 comprised of a non-electrically conductive material, such as ceramic, couple the intermediate cylinder 64 to the outer cylinder 62. A first end of the intermediate cylinder 64 terminates before reaching the end plate 61, leaving a space therebetween. The opposite end of the intermediate cylinder 64 is electrically connected to the grid terminal plate 18 through a socket 19 having a frusto-conical shape.

An inner cylinder 66 is spaced within the intermediate cylinder 64 along the common axis. Annular shaped spacers 81, 83 comprised of a non-electrically conductive material, such as ceramic, couple the intermediate cylinder 64 to the inner cylinder 66. A first end of the inner cylinder 66 terminates at the same axial point as the first end of the intermediate cylinder 64. The opposite end of the inner cylinder 66 is coupled to the cathode terminal plate 13.

A high negative DC voltage, such as −32 kV, is applied by a cathode voltage source labeled CATHODE (see also FIG. 6) to the cathode terminal plate 13 through an electrically insulated lead. Similarly, current for the cathode heater 25 and the ion pump 15 are supplied by sources labeled HEATER and ION PUMP (see also FIG. 6), respectively, through corresponding electrically insulated leads. A DC bias voltage, such as −200 V relative to the cathode 8, is applied by a voltage source labeled BIAS through an electrically insulated lead to the inner cylinder 66.

Figure 6:
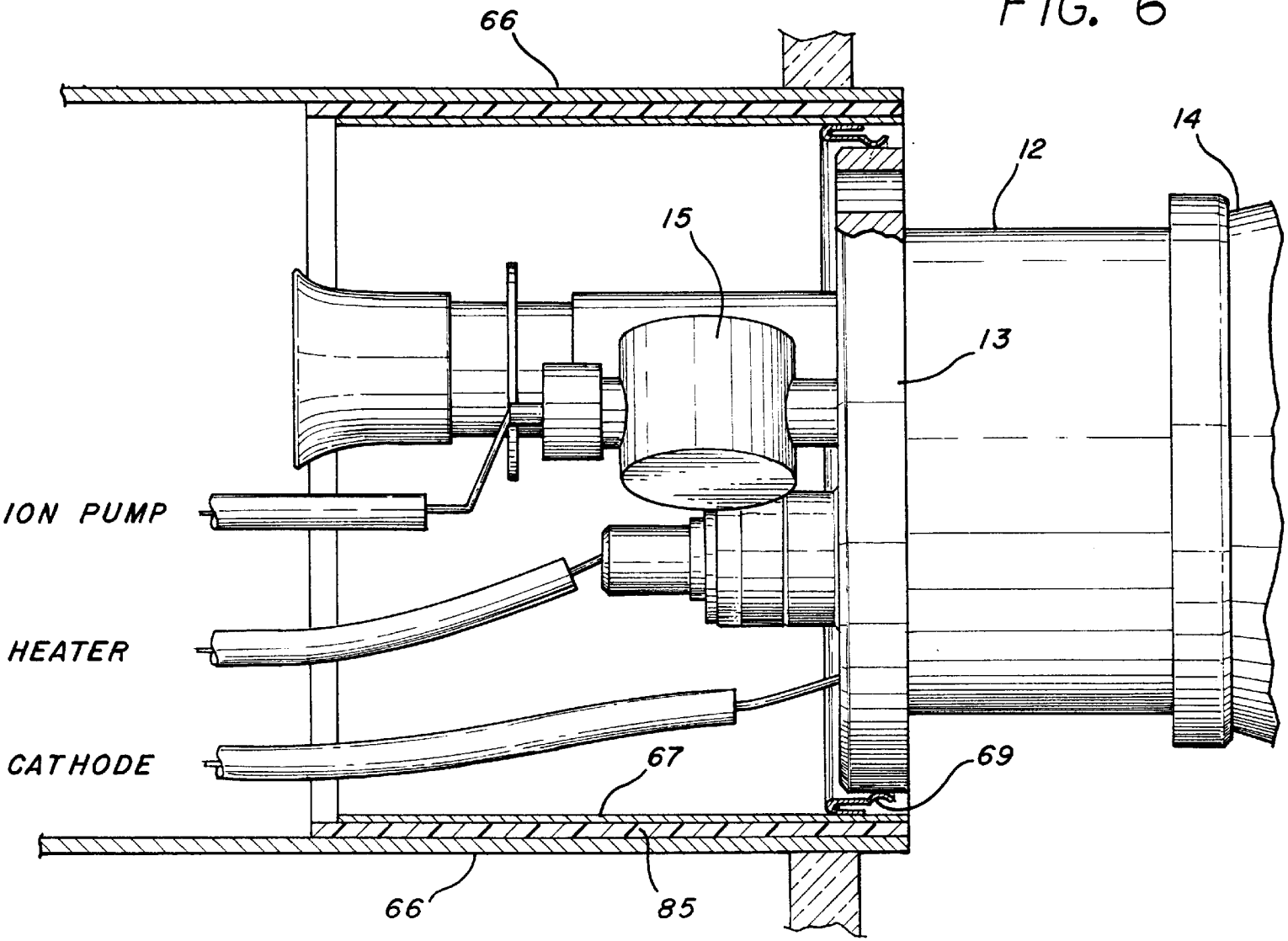
FIG. 6 is an enlarged cross-sectional side view of a cathode capsule coupled to a signal input assembly of the present invention.

Referring briefly to FIG. 6, the coupling between the inner cylinder 66 and the cathode terminal plate 13 is illustrated in greater detail. A sleeve 67 includes a plurality of conductive fingers 69 at an end thereof. The sleeve 67 is comprised of an electrically conductive material, such as copper, and further includes a dielectric layer 85 wrapped around the periphery of the sleeve. The sleeve 67 is disposed inside the inner cylinder 66 with the dielectric layer 85 in direct contact with the inner surface of the inner cylinder, and the conductive fingers 69 in electrical contact with the edge of the cathode terminal plate 13. The dielectric layer 85, such as comprised of KAPTON, TEFLON or nylon, operates as a choke (i.e., DC block or bypass capacitor) to provide DC isolation between the cathode terminal plate 13 and the inner cylinder 66, in order to maintain a DC bias voltage between the cathode 8 and the grid 6. The sleeve 67 and dielectric layer 85 extend in the axial direction away from the cathode 8 by a length equal to approximately $\lambda/4$, where $\lambda$ is the wavelength of the input RF signal in the dielectric layer 85. FIG. 6 further illustrates the outer surface of the first cylindrical shell 12 and a portion of the cathode-grid insulator 14.

The conductive fingers 69 have a spring bias that maintains a positive electrical connection with the cathode terminal plate 13. The conductive fingers 69 are comprised of a flexible, electrically conductive material, such as copper. The use of the conductive fingers, rather than a rigid electrical connection, facilitates simplified disassembly of the inductive output amplifier from the signal input assembly. It should be appreciated that similar conductive fingers may also be utilized to maintain an electrical connection between the socket 19 and the grid terminal plate 18, and between the curved flange 63 and the anode terminal plate 24, shown in FIG. 2.

Returning now to FIG. 2, the intermediate cylinder 64 and the inner cylinder 66 provide a coaxial transmission line which extends to the cathode-grid interaction region, and the space between the cylinders defines an input cavity for RF input signals provided to the inductive output amplifier. The input cavity includes a coupling loop 82 disposed within a dome 84 having a DC insulating capability, such as comprised of a ceramic material like aluminum oxide ($Al_2O_3$). The DC insulating capability of the dome 84 is necessary to permit the RF input signal having approximately zero DC voltage to be coupled into the input cavity which is at a high negative DC voltage (e.g., −32 kV). The coupling loop 82 is electrically connected through an insulated coaxial line to receive the RF input signal (labelled RF INPUT) which is inductively coupled as an RF field into the input cavity. The RF fields induced into the input cavity propagate through the socket 19 and grid terminal plate 18 to result in an RF voltage being defined between the grid 6 and the cathode 8. As known in the art, the electron beam emitted by the cathode 8 becomes density modulated by the RF input signal applied to the input cavity.

The input cavity may be inductively tuned to a desired frequency range. An annular shaped shorting plunger 68 is coupled to a threaded rod 72, and is caused to move axially within the input cavity by operation of gears 78 and 77. The gear 77 is coupled to a hand crank 79 that protrudes through a portion of the outer cylinder 62. The gear 78 has an axially threaded bore that is in mesh with the threaded rod 72. The gear 77 is in mesh with gear 78 such that rotation of the hand crank 79 causes rotation of the gear 78, further causing axial movement of the shorting plunger 68. The shorting plunger 68 is comprised of an electrically conductive material, such as brass or aluminum, to conduct both RF and DC currents between the intermediate cylinder 64 and the inner cylinder 66 (i.e., between the outer conductor and center conductor of the coaxial transmission line). The threaded rod 72 is comprised of an electrically insulating material, such as nylon. A sleeve 75 extends axially from the gear 78 to cover the threads of the threaded rod 72. It should be appreciated that the position of the shorting plunger 68 within the input cavity may be controlled by other known mechanical systems, including but not limited to motors, belts or pulleys.

The coupling loop 82 and dome 84 protrude through a portion of the shorting plunger 68 and are moveable in the axial direction in cooperation with the shorting plunger. The dome 84 has an elongated portion 86 that extends axially past the ends of the intermediate and inner cylinders 64, 66. Alternatively, the elongated portion 86 may be formed of separate telescoping elements that expand or contract as necessary to accommodate axial movement of the shorting plunger 68. The insulated coaxial lead connected to the coupling loop 82 passes through the elongated portion 86.

Figure 5:
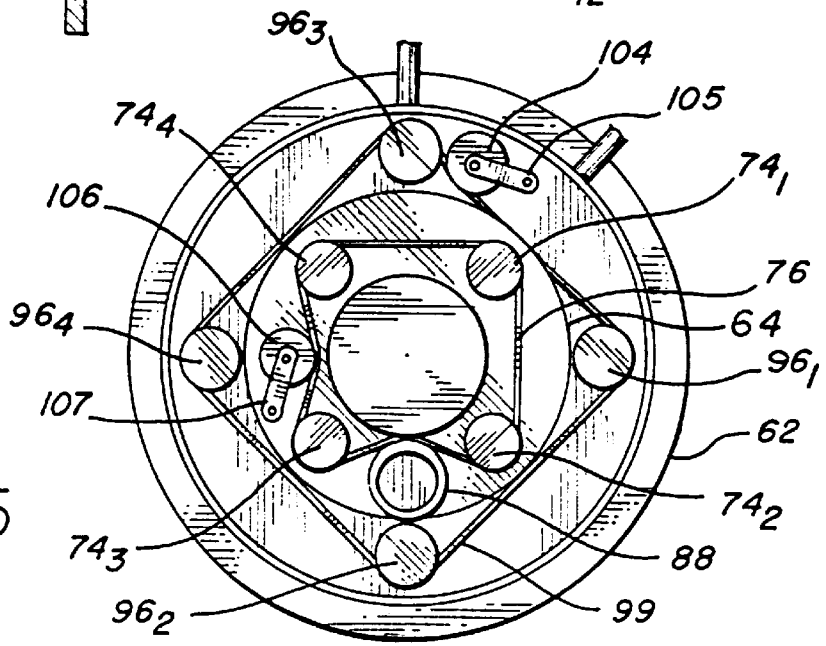
FIG. 5 is an end sectional view of the second embodiment of the signal input assembly for the inductive output amplifier.

To move the shorting plunger 68 smoothly within the input cavity without binding, it may be necessary to employ a plurality of threaded rods similar to the threaded rod 72 shown in FIG. 2. The gear 78 has an axially coupled pulley 74 that rotates in cooperation therewith. Similarly, a pulley 88 (see FIG. 5) is provided concentrically around the elongated portion 86 of the dome 84. As shown in FIG. 5, a plurality of pulleys $\mathbf{74}_1$, $\mathbf{74}_2$, $\mathbf{74}_3$, $\mathbf{74}_4$ may be provided, with each pulley corresponding to an associated one of the threaded rods coupled to the shorting plunger 68 (see FIG. 2) The pulleys $\mathbf{74}_1$–$\mathbf{74}_4$ and 88 may be coupled by a belt 76 (also shown in FIG. 2) to coordinate operation of the threaded rods. The belt 76 may be comprised of a high strength, light weight material, such as nylon, and may further include a surface texture such as teeth to prevent slippage. An additional pulley 106 coupled to a pivot arm 107 may be moved into engagement with the belt 76. The additional pulley 106 can thereby be adjusted to take up any slack in the belt 76.

The space defined between the outer cylinder 62 and the intermediate cylinder 64 is referred to herein as a grid-anode cavity, as it provides a parallel resonance that is directly coupled to the interaction region defined between the grid 6 and the anode 7 (see FIG. 4). In order to provide a low impedance to the interaction region, the outer cylinder 62 and the intermediate cylinder 64 are comprised of a material having a high surface resistivity, such as iron or steel. The high RF surface resistivity of the grid-anode cavity materials produces a parallel resonance having low Q (i.e., quality factor) and consequently a low impedance at the grid-anode interaction region. As a result, any RF energy radiated into the grid-anode cavity will be damped out quickly without regeneration into the cathode 8.

It is well known in the art that RF current is concentrated in a relatively small surface region of a conductor, i.e., the "skin effect" of a conductor. The surface resistivity of a material is proportional to the square root of its permeability divided by its conductivity. Both iron and steel are magnetic metals having a relatively high permeability value and a low conductivity value; hence, these materials have a relatively high surface resistivity. The Q of a resonator is the energy stored (U) divided by the power dissipated per cycle ($P_L/\omega$). The high surface resistivity of the grid-anode cavity materials will have high relative energy dissipation and therefore low Q. Since Q is also proportional to the impedance ($Z_0$), a reduction of Q equates to a reduction of impedance.

More particularly, the characteristic impedance $Z_0$ of a transmission line is given by the equation:

$$Z_0 = \sqrt{\frac{L}{C}}$$

where L is the inductance per unit length of a transmission line and C is the capacitance per unit length of the transmission line. The ratio of the shunt resistance ($R_{SH}$) to Q for any resonant circuit is given by the equation:

$$\frac{R_{SH}}{Q} = \frac{V_m^2}{2\omega U}$$

in which $V_m$ is the maximum voltage across the terminals at which $R_{SH}$ appears, ω is the angular frequency, and U is the energy stored in the line. For a coaxial resonator having a length that is a multiple n of a quarter wavelength (λ/4), the ratio of the shunt resistance ($R_{SH}$) to Q reduces to:

$$\frac{R_{SH}}{Q} = \frac{4Z_0}{\pi n}$$

The Q of a coaxial resonator is proportional to $Z_0$, and inversely proportional to the surface resistance $R_s$ per unit length, as follows:

$$Q = \frac{2\pi Z_0}{\lambda R_s}$$

Accordingly, the high surface resistivity of iron or steel at the parallel resonance in the grid-anode cavity should result in a low impedance, or shunt resistance $R_{SH}$, measured at the interaction region. Since the $R_{SH}/Q$ is inversely proportional to length, it should be appreciated that the longer the coaxial resonator, the lower the shunt resistance $R_{SH}$ will be.

As noted above, the intermediate cylinder 64 provides both the outer conductor for the input cavity and the center conductor for the grid-anode cavity. This is made possible by the "skin effect" discussed above. Since the current at high frequencies is concentrated into a thin layer of a conductor, the conductive intermediate cylinder 64 actually acts as a barrier to prevent the RF current in the input cavity from being conducted into the grid-anode cavity, and vice versa. To preclude dissipation of the RF current in the input cavity, a low surface resistivity coating is applied to the surfaces of the intermediate cylinder 64 and the inner cylinder 66 facing into the input cavity. This may be accomplished by plating a layer of silver, or other material having high conductivity and low permeability, onto the surfaces of the input cavity.

Figure 3:
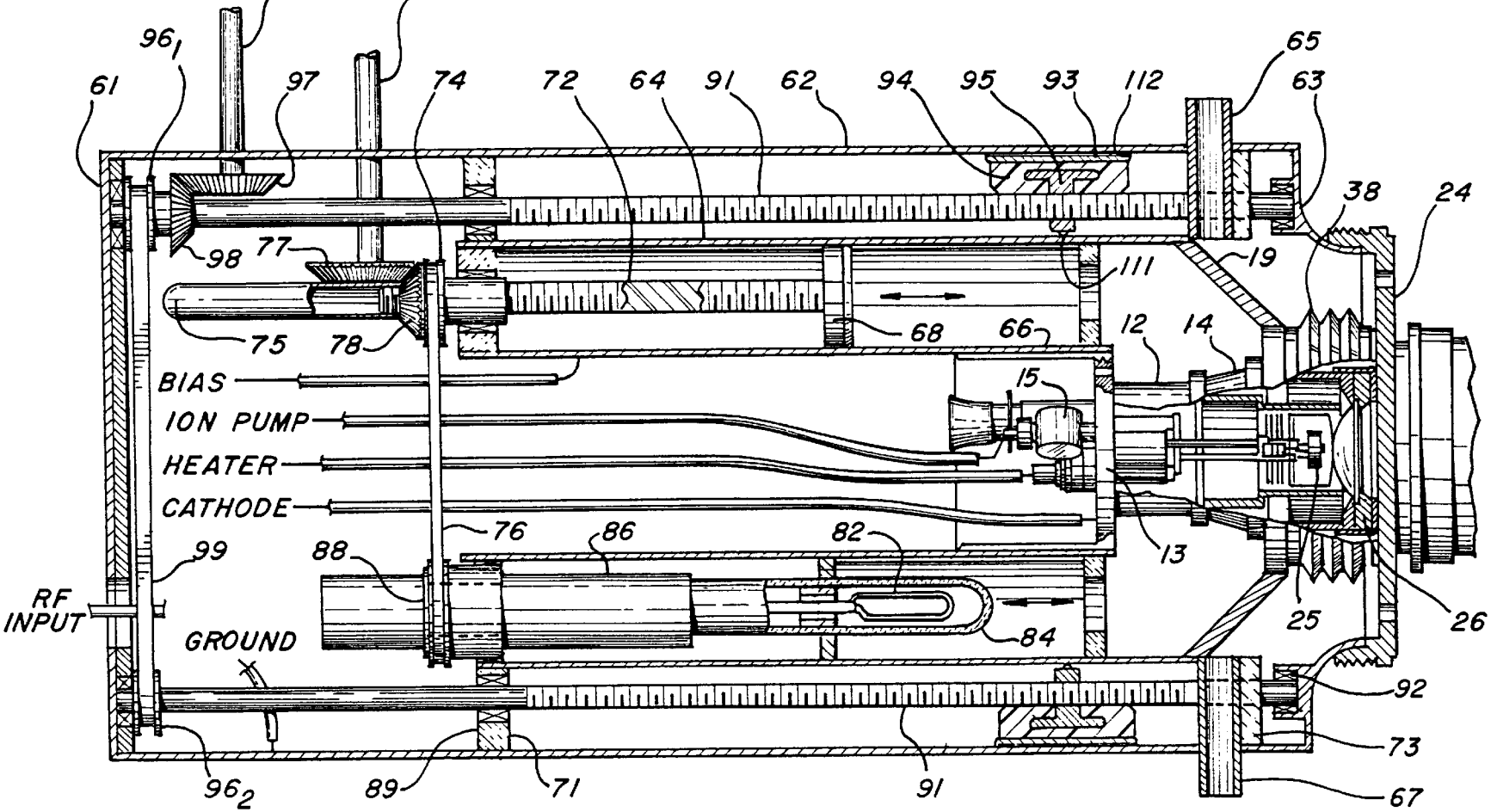
FIG. 3 is a cross-sectional side view of a second embodiment of a signal input assembly for the inductive output amplifier.

Referring now to FIG. 3, a second embodiment of a signal input assembly for the inductive output amplifier is illustrated. The second embodiment is generally similar in construction to the first embodiment described above, and a description of like elements (designated by like reference numerals) of the two embodiments is therefore omitted. The signal input assembly of the second embodiment differs with the addition of an adjustable choke which provides an RF short circuit and a DC open circuit within the grid-anode cavity to define a transmission line having an electrical length approximately equal to nλ/4, where λ is the wavelength of the input RF signal, and n is an even integer. By defining the transmission line to be an even multiple of a quarter wavelength λ/4, the impedance at the interaction region will be zero.

The choke adjustment comprises a plurality of threaded rods 91 extending in an axial direction through the grid-anode cavity. The threaded rods 91 are rotationally supported by a first bearing 89 disposed in spacer 71 and a second bearing 92 affixed to the curved flange 63. The threaded rods 91 are comprised of an electrically insulating material, such as nylon. An annular choke assembly is carried by the threaded rods 91, and includes an outer electrode portion 93, a dielectric portion 94, and an inner electrode portion 95. The outer electrode portion 93 provides a broad, annular surface spaced from the outer cylinder 62. A conductive finger 112 extends between the outer electrode portion 93 and the outer cylinder 62 to provide an electrical connection therebetween. The inner electrode portion 95 includes a narrow surface that has a conductive finger 111 that comes into contact with the intermediate cylinder 64, a threaded opening in mesh with the threaded rods 91, and a wide surface that engages the dielectric portion 94. The dielectric portion 94 envelopes the wide surface of the inner electrode portion 95 and has an annular surface in contact with the outer electrode portion 93.

The dielectric portion 94 provides DC isolation between the outer cylinder 62 and the intermediate cylinder 64 to maintain a large DC voltage between the grid 6 and the anode 7 (shown in FIG. 4), and may be comprised of suitable dielectric material such as KAPTON, TEFLON, nylon or epoxy. At the same time, the dielectric portion 94 also provides an RF short circuit for terminating the grid-anode cavity. By positioning the adjustable choke axially within the grid-anode cavity so that it lies on a series resonance position coinciding with an even multiple of a quarter wavelength $\lambda/4$ from the interaction region between the grid 6 and the anode 7, the impedance at the interaction region will be zero and no voltage can be developed across it.

Axial movement of the choke is provided by gears 98 and 97. The gear 97 is coupled to a hand crank 101 that protrudes through a portion of the outer cylinder 62. The gear 98 is coupled axially to one of the threaded rod 91. The gear 97 is in mesh with gear 98 such that rotation of the hand crank 101 causes rotation of the gear 98, further causing axial movement of the adjustable choke. As with the shorting plunger 68 discussed above, it is necessary to move the adjustable choke smoothly within the grid-anode cavity without binding. Accordingly, a plurality of threaded rods similar to the threaded rod 91 shown in FIG. 3 are employed. The gear 98 has an axially coupled pulley 96, that rotates in cooperation therewith.

As shown in FIG. 5, a plurality of pulleys $\mathbf{96}_1$, $\mathbf{96}_2$, $\mathbf{96}_3$, $\mathbf{96}_4$ may be provided, with each pulley corresponding to an associated one of the threaded rods coupled to the adjustable choke. The pulleys $\mathbf{96}_1$–$\mathbf{96}_4$ may be coupled by a belt 99 to coordinate operation of the threaded rods 91. The belt 99 may be comprised of a high strength, light weight material, such as nylon, and may further include a surface texture such as teeth to prevent slippage. An additional pulley 104 coupled to a pivot arm 105 may be moved into engagement with the belt 99. The additional pulley 104 can thereby be adjusted to take up any slack in the belt 99. It should be appreciated that the position of the adjustable choke within the grid-anode cavity may be controlled by other known mechanical systems, including but not limited to motors, belts or pulleys.

Alternatively, the high voltage choke may be provided by disposing a layer of dielectric material along the inner surface of the outer cylinder 62. An axially movable shorting plunger may be disposed in the grid-anode cavity in the same manner as the adjustable choke described above with respect to FIG. 3, although the shorting plunger is comprised of electrically conductive materials, such as brass or aluminum, to conduct both RF and DC currents between the intermediate cylinder 64 and the dielectric layer provided on the outer cylinder 62. This way, the grid-anode cavity may be adjusted to define a transmission line having an electrical length approximately equal to $n\lambda/4$, where $\lambda$ is the wavelength of the input RF signal, and n is an even integer. The layer of dielectric material will maintain the large DC voltage between the grid 6 and the anode 7.

It should also be appreciated that the adjustable choke could be moved slightly off the series resonance position so that the electron beam is presented with a small inductive reactance at the axis of the interaction region. Adjusted in this manner, the RF voltage across the interaction region will be 90° out of phase with the beam current, so that electrons ahead of the electron bunch center will see a decelerating force while electrons behind the center of the bunch will see an accelerating force. This adjustment will overcome some of the normal debunching space charge forces and will increase efficiency of the inductive output amplifier.

Having thus described a preferred embodiment of a low impedance grid-anode interaction region for an inductive output amplifier, it should be apparent to those skilled in the art that certain advantages of the within described system have been achieved. It should also be appreciated that various modifications, adaptations, and alternative embodiments thereof may be made within the scope and spirit of the present invention. For example, the input cavity and grid-anode cavity described above with respect to FIGS. 2 and 3 were disposed in a coaxial configuration, but it should be appreciated that radially disposed cavities could also be advantageously utilized.

The invention is further defined by the following claims.

What is claimed is:

1. In a linear beam amplification device having an axially centered electron emitting cathode and an anode spaced therefrom, said cathode providing an electron beam in response to a high voltage potential applied between said cathode and said anode, a control grid spaced between cathode and anode for modulating the electron beam in response to an applied input signal, a signal input assembly comprises:

an input cavity including means for inductively coupling said input signal into said input cavity, said grid being coupled to said input cavity;

a moveable tuning plunger disposed within said input cavity, said inductive coupling means being coupled to said tuning plunger allowing cooperative movement therewith; and a grid-anode cavity adjacent with said input cavity and in communication with an interaction region defined between said grid and said anode, said grid-anode cavity presenting a low impedance to said interaction region, said grid-anode cavity having walls comprised of a material having a high surface resistivity to attenuate RF resonances originating from said interaction region without RF absorbing material being affixed to said walls.

2. The signal input assembly of claim 1, wherein said input cavity further comprises a substantially cylindrical shape.

3. The signal input assembly of claim 1, wherein said grid-anode cavity and said input cavity are coaxially disposed about said axially centered emitting cathode, said grid-anode cavity walls further comprising a common wall separating said grid-anode cavity from said input cavity.

4. The signal input assembly of claim 3, wherein said grid-anode cavity further comprises an outer wall substantially enclosing said grid-anode cavity.

5. The signal input assembly of claim 1, wherein said material further comprises iron.

6. The signal input assembly of claim 1, wherein said input cavity is provided with a coating having a relatively low surface resistivity.

7. The signal input assembly of claim 6, wherein said coating further comprises silver.

8. The signal input assembly of claim 1, further comprising means for providing an RF transparent vacuum seal within said interaction region between said grid and said anode thereby surrounding said beam.

9. The signal input assembly of claim 8, wherein said means for providing an RF transparent vacuum seal further comprises a silicone rubber material substantially free of RF absorbing constituent elements.

10. In a linear beam amplification device having an axially centered electron emitting cathode and an anode spaced therefrom, said cathode providing an electron beam in response to a high voltage potential applied between said cathode and said anode, a control grid spaced between said cathode and anode for modulating the electron beam in response to an applied input signal, a signal input assembly comprises:

an input cavity including means for inductively coupling said input signal into said input cavity, said grid being coupled to said input cavity;

a moveable tuning plunger disposed within said input cavity, said inductive coupling means being coupled to said tuning plunger allowing cooperative movement therewith; and a grid-anode cavity adjacent with said input cavity and in communication with an interaction region defined between said grid and said anode, said grid-anode cavity presenting a low impedance to said interaction region, wherein said grid-anode cavity further comprising means for tuning said grid-anode cavity to define a transmission line having an electrical length approximately equal to $n\lambda/4$, where $\lambda$ is the wavelength of said input RF signal, and n is an even integer.

11. The signal input assembly of claim 10, wherein said grid-anode cavity tuning means further comprises a movable choke disposed within said grid-anode cavity, said choke being adapted to conduct RF currents while maintaining a large DC voltage applied between said grid and said anode.

12. A linear beam electron tube having a longitudinal axis for use with an inductive output cavity, comprising:

an axially centered electron emitting cathode and an anode spaced therefrom, said cathode being coupled to a voltage source providing a high voltage potential between said cathode and said anode, said cathode providing an electron beam in response to said high voltage potential;

a control grid spaced between said cathode and anode, said grid being connected to an input RF signal in order to density modulate said beam;

a grid-anode cavity in communication with an interaction region defined between said grid and said anode, said grid-anode cavity having walls comprised of a material having a high surface resistivity to attenuate RF resonances originating from said interaction region without RF absorbing material being affixed to said walls;

a drift tube spaced from said electron gun and surrounding said beam and including a first portion and a second portion, a gap being defined between said first and second portions, said gap being coupled to said cavity, said density modulated beam passing across said gap to thereby induce an output RF signal into said cavity; and a collector spaced from said drift tube, the electrons of said beam passing into said collector after transit across said gap.

13. The linear beam electron tube of claim 12, wherein said grid-anode cavity walls material further comprises iron.

14. The linear beam electron tube of claim 12, further comprising an input cavity coupled to said grid, said input cavity including means for coupling said input RF signal into said input cavity.

15. The linear beam electron tube of claim 14, wherein said grid-anode cavity and said input cavity are coaxially disposed about said longitudinal axis, said grid-anode cavity walls further comprising a common wall separating said grid-anode cavity from said input cavity.

16. The linear beam electron tube of claim 15, wherein said grid-anode cavity walls further comprise an outer wall that substantially encloses said grid-anode cavity.

17. The linear beam electron tube of claim 14, wherein said coupling means further comprises an inductive coupling loop.

18. The linear beam electron tube of claim 14, wherein said input cavity is provided with a coating having a low surface resistivity.

19. The linear beam electron tube of claim 18, wherein said coating further comprises silver.

20. The linear beam electron tube of claim 14, wherein said input cavity further comprises a substantially cylindrical shape.

21. The linear beam electron tube of claim 14, further comprising means for tuning resonance of said input cavity.

22. The linear beam electron tube of claim 21, wherein said resonance tuning means further comprises a moveable plunger disposed within said input cavity.

23. The linear beam electron tube of claim 12, further comprising an RF transparent insulator disposed within said interaction region and extending between said grid and said anode.

24. The linear beam electron tube of claim 23, wherein said RF transparent insulator further comprises a silicone rubber material substantially free of RF absorbing constituent elements.

25. A linear beam electron tube having a longitudinal axis for use with an inductive output cavity, comprising:

an axially centered electron emitting cathode and an anode spaced therefrom, said cathode being coupled to a voltage source providing a high voltage potential between said cathode and said anode, said cathode providing an electron beam in response to said high voltage potential;

a control grid spaced between said cathode and anode, said grid being coupled to an input RF signal to density modulate said beam;

a grid-anode cavity in communication with an interaction region defined between said grid and said anode, said grid-anode cavity further comprising means for tuning said grid-anode cavity to define a transmission line having an electrical length approximately equal to $n\lambda/4$, where $\lambda$ is the wavelength of said input RF signal, and n is an even integer, said transmission line thereby presenting substantially zero impedance to said interaction region;

a drift tube spaced from said electron gun and surrounding said beam and including a first portion and a second portion, a gap being defined between said first and second portions, said gap being coupled to said output cavity, said density modulated beam passing across said gap to thereby induce an output RF signal into said output cavity; and a collector spaced from said drift tube, the electrons of said beam passing into said collector after transit across said gap.

26. The linear beam electron tube of claim 25, wherein said grid-anode cavity tuning means further comprises an adjustable choke disposed within said grid-anode cavity, said choke being adapted to conduct RF currents while maintaining an applied DC bias voltage between said grid and said cathode.

27. The linear beam electron tube of claim 25, further comprising an input cavity coupled to said grid and including means for coupling said input RF signal into said input cavity.

28. The linear beam electron tube of claim 27, wherein said grid-anode cavity is coaxially disposed about said longitudinal axis with said input cavity, said grid-anode cavity and said input cavity being separated from each other by a common wall.

29. The linear beam electron tube of claim 27, wherein said coupling means further comprises an inductive coupling loop.

30. The linear beam electron tube of claim 27, wherein said input cavity is provided with a coating having a low surface resistivity.

31. The linear beam electron tube of claim 30, wherein said coating further comprises silver.

32. The linear beam electron tube of claim 27, wherein said input cavity further comprises a substantially cylindrical shape.

33. The linear beam electron tube of claim 27, further comprising means for tuning resonance of said input cavity.

34. The linear beam electron tube of claim 33, wherein said resonance tuning means further comprises a moveable plunger disposed within said input cavity.

35. The linear beam electron tube of claim 25, further comprising means for providing an RF transparent vacuum seal within said interaction region between said grid and said anode thereby surrounding said beam.

36. The linear beam electron tube of claim 35, wherein said means for providing an RF transparent vacuum seal further comprises a silicone rubber material substantially free of RF absorbing constituent elements.

* * * * *